United States Patent [19]

Hinchman et al.

[11] Patent Number: 5,058,012

[45] Date of Patent: Oct. 15, 1991

[54] METHOD OF EXTRAPOLATING RESERVOIR PERFORMANCE

[75] Inventors: Steven B. Hinchman, Houston, Tex.; Raymond T. Brickey, Anchorage, Ak.; Michael J. Heymans, Highlands Ranch, Colo.

[73] Assignee: Marathon Oil Company, Findlay, Ohio

[21] Appl. No.: 609,039

[22] Filed: Nov. 5, 1990

Related U.S. Application Data

[63] Continuation-in-part of Ser. No. 307,551, Feb. 7, 1989, abandoned.

[51] Int. Cl.[5] ..... E21B 49/00

[52] U.S. Cl. ..... 364/420; 73/153

[58] Field of Search ..... 364/420, 422; 73/151, 73/153

[56] References Cited

U.S. PATENT DOCUMENTS 4,548,071 10/1985 Habiger ..... 73/152

4,638,447 1/1987 Odeh ..... 364/556

*Primary Examiner*—Clark A. Jablon

*Attorney, Agent, or Firm*—Jack L. Hummel; Jack E. Ebel

[57] ABSTRACT

A method of determining a numerical index from a cored well that corresponds to the performance data of a portion of a reservoir and a method of extrapolating the performance of such portion of a reservoir to the entire reservoir through use of the numerical index. Selected variables which affect fluid flow in the reservoir are compared by a statistical analysis computer program to performance data of the computer simulated portion of the reservoir after both the data and variables have been normalized to dimensionless values. The resulting numerical index is computed for the cored wells both inside and outside the small reservoir area, and a contour or iso-index map is drawn. Well performance outside the simulated area can be compared to expected performance through the numerical index values.

9 Claims, 2 Drawing Sheets

METHOD OF EXTRAPOLATING RESERVOIR PERFORMANCE

FIELD OF THE INVENTION

This invention relates to a method of determining oil field reservoir performance. More particularly, it relates to a method of determining reservoir performance in locations outside the area of oil field reservoir computer simulation.

BACKGROUND OF THE INVENTION

Effective oil reservoir management requires the ability to accurately estimate what the current and future performance of existing wells should be and to predict the performance of wells in undeveloped areas. This requires a continuing process of geologic and engineering study, which has led to the use of numerical reservoir simulation models. These models are a powerful tool for analyzing the production history of a reservoir and for predicting future performance under a variety of possible operating methods.

In order to create an acceptable model an accurate reservoir description is essential. This is developed through available geologic and engineering data. The reservoir description is then incorporated into a computer simulation model which is used to verify and further refine the reservoir description through matching of pressure and production data. The refined simulation model is used to project future reservoir performance under current operations and to evaluate alternative operating plans.

Reservoir descriptions may be produced in a number of different ways. For example, in one approach core data are combined with the geologic reservoir description to determine the three-dimensional distribution of porosity and permeability throughout all the geologically defined layers of the reservoir, and a three-dimensional grid system incorporating the layers is used in the model. Because of the amount of resolution in the vertical dimension caused by the definition of the geologic layers the areal grid in this procedure has to be kept relatively coarse so as not to cause excessive computer run time. In any event, despite the grid size utilized, the use of a computer program to simulate performance in a large field requires that a great deal of time and effort be spent in gathering, verifying and loading data. It also requires an amount of computer capacity and available computer time which is normally beyond the means of smaller companies and which is sought to be minimized by the larger companies.

In another approach the field is divided into segments each of which represents an area enclosed within no-flow boundaries. Simulations are conducted for each segment independent of the other segments. The response for each segment can then be pieced together to obtain the response for the entire field or similar field segments are collected into groups with like characteristics, with a single prototype being assigned to each group. Aside from questions which may be raised as to the accuracy of the method, this approach requires the development of models for the entire field under study, which again requires great deal of computer capacity and computer time.

In another approach a model is built by comparing logging data with computer-simulated subsurface characteristics within discretely-boundaried beds. This approach, like the others described, requires actual data from the entire field it is desired to model, and so suffers from the same problems of data entry demands and computer expense and availability.

Regardless of the specific manner of building a computer model, in an effort to reduce the amount of computer simulation required it is common to select a certain relatively small number of wells which can be handled by the available computer capacity and to use them as a window area for the rest of the field. Thus a model derived from these selected wells would be used as an indicator of performance for larger areas of the field. Even this approach, however, can be very expensive and not practical for a relatively small company of limited means.

It is apparent that a different type of reservoir simulation which does not have the great computer demands of the prior art methods is needed.

SUMMARY OF THE INVENTION

According to one aspect of the invention, a method is provided for determining a numerical rock index expression of core data which corresponds to oil field reservoir computer simulation results. Core data is first obtained from oil wells in and/or near the area of the reservoir to be simulated, and significant variables of the core data which affect fluid flow in the reservoir are selected. In order to compare the core data variables to the performance data of the simulated area of the reservoir the variables and the performance data are both normalized. Then by comparing the normalized values through a statistical analysis program an equation is created based on the sum of the core data variables, and the resulting numerical expression for each cored well substantially corresponds to the performance data for the simulated area of the reservoir.

In another aspect of the invention, core data is obtained from wells which are within the boundaries of the reservoir but which are outside the area which has been simulated. This additional core data is also normalized and run through the equation previously created to compute a numerical rock index for each additional well. A contour map is then constructed of the rock index numbers. This enables the performance of a well in the reservoir outside the simulated area to be checked by determining the rock index value of the well from the contour map and comparing the performance of the well against the performance indicated by the index number. Similarly, the performance of an undeveloped area within the reservoir but outside the simulated area can be predicted by determining the rock index number of the undeveloped area from the contour map and then determining the performance projected by the index number.

The data is normalized to permit comparison of flow rates from the performance curves of the reservoir area which is simulated with the variables of rock formation which affect flow rate. This is done by describing the data and variables in dimensionless terms capable of treatment in a statistical analysis program.

The invention enables well performance to be checked and forecasted quickly and accurately based on only a relatively small amount of data and requiring only a minimum of computer time.

Other features and aspects of the invention, as well as other benefits of the invention, will readily be ascertained from the more detailed description of the invention which follows.

DESCRIPTION OF THE PREFERRED EMBODIMENT

Figure 1:
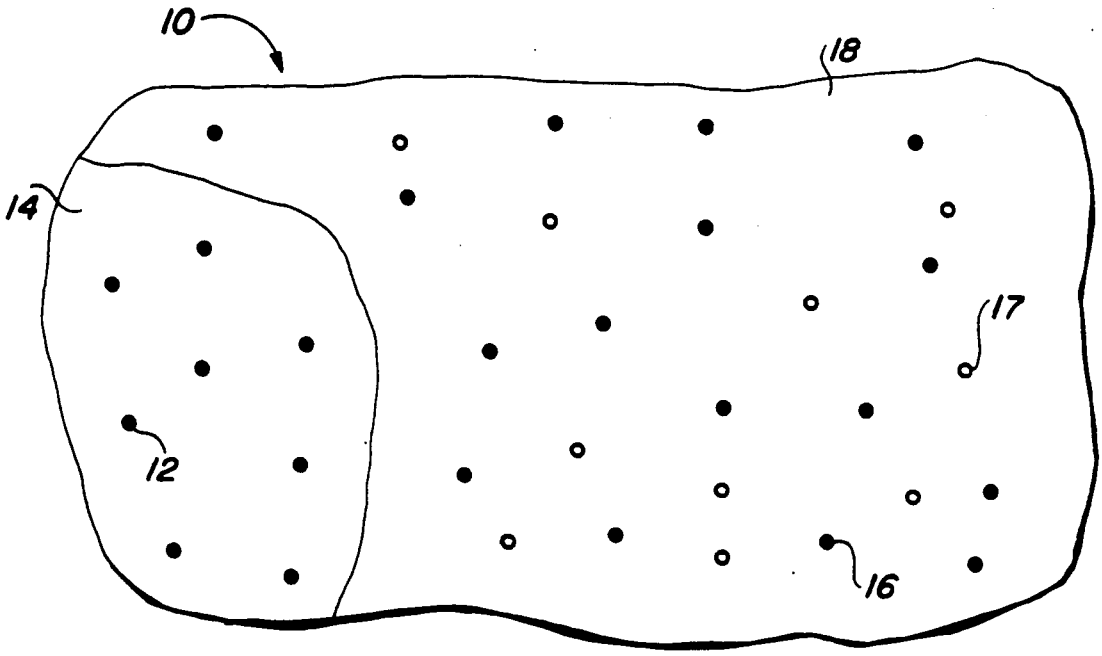
FIG. 1 is a simplified plan view of a map of a reservoir area showing the location of producing and cored wells.

Referring to FIG. 1, a map of a reservoir area 10 shows the location of a number of cored wells 12 within an area 14 corresponding to a computer reservoir simulation model. The map also shows a number of cored wells 16 and uncored wells 17 in the area 18 outside the reservoir simulation area 14. Until the present invention it would have been necessary to incorporate the entire reservoir area 10, or selected windows of the area, in a model in order to check the performance of both cored and uncored wells located throughout the reservoir area or to forecast the performance of undeveloped parts of the reservoir. According to the present invention, however, it is only necessary to simulate a portion of the reservoir area in order to investigate the entire reservoir and the simulated portion of the reservoir may be relatively small in number of wells and/or aerial extent in comparison to the entire reservoir.

The method of the invention requires that the performance data of the simulated portion of the reservoir be normalized to enable comparison with core data from the cored wells. The value of the performance curve to which core data is compared was expressed as the percent pore volume of oil produced at one pore volume of fluid injected. This dimensionless expression correlates with well performance but eliminates problems associated with varying completion interval thicknesses and with cumulative oil production.

The parameters of the core data to be investigated are those which are determined to have an effect on fluid flow in the reservoir. These would vary depending on the type of rock formation. For example, some factors which are pertinent to a carbonate reservoir would not be pertinent to a sandstone reservoir. Examples of parameters to be considered are fracture intensity, stylolite content, shaliness or non-reservoir rock, permeability, porosity, pore size distribution, wettability, the presence of caves and the presence of calcite cement. As in the case of the performance data, it is necessary for the various parameters to be expressed in numerical dimensionless terms so that the resulting rock index values will be normalized and can thus be compared to the normalized performance data of the simulated portion of the reservoir. In addition, bottom hole pressure, although not obtained from core data, may be sufficiently significant to be included.

As an example of the way the variables are normalized, certain parameters were determined in an actual study made on an existing oil field as being pertinent to fluid flow in a carbonate reservoir and were defined in the following manner. The fracture intensity term was defined as the ratio of the number of cored feet having at least one natural fracture to the total number of cored feet. The stylolite content term was defined as the ratio of the number of cored feet having at least one stylolite in reservoir rock of at least 7% porosity to the number of feet of reservoir rock of at least 7% porosity. The shaliness or non-reservoir rock term was defined as the ratio of the number of feet of rock of at least 7% porosity to the total number of cored feet. The permeability factor was defined as the ratio of the number of cored feet having at least one millidarcy matrix permeability to the number of cored feet of rock with a porosity of at least 7%. The porosity ratio term was defined as the ratio of the number of feet of reservoir interval of at least 15% porosity to the total number of feet of rock of at least 7% porosity. The reservoir pressure term was defined as the ratio of the current bottom hole pressure to the desired pressure maintenance pressure.

It should be understood that the 7% and 15% porosities referred to above were significant to the particular reservoir being studied but are not necessarily the porosities that would be used in normalizing variables in other reservoirs. The 7% porosity is a "cut-off" porosity corresponding to the porosity below which the porosity of the rock does not contribute significant fluid flow in the reservoir. The 15% porosity is the porosity corresponding to the porosity above which there is a significant increase in the fluid flow properties of the reservoir rock. Because in some reservoirs there is no significant increase in fluid flow properties above the cut-off porosity, exhibiting instead a linear trend in a porosity versus permeability plot on semi-log paper, the upper value need not always be present. The lower cut-off value is normally present, however, because in almost all reservoirs there is a cut-off porosity of significance.

Using a commercially available statistical analysis program the rock index values were compared to the respective values on the performance curves of the reservoir computer simulation, creating a rock index equation equal to the sum of the products of each of the ratios multiplied by a constant. Thus if each of the ratios expressing a fluid flow factor is assigned a different letter A, B, C, D, etc., and the different constants are assigned the notation $k_1$, $k_2$, $k_3$, $k_4$, etc., the rock index (RI) equation would be:

$$RI = k_1A + k_2B + k_3C + k_4D \ldots$$

If a factor is studied and found to have only a minor impact on the comparison of the variables to the performance curve, or if its influence is found to be expressed satisfactorily by other factors, then the factor is simply dropped from the comparison and does not appear in the equation. For example, in the above study it was found that the stylolite content and the permeability factor had little influence on the comparison and so were not retained. That this was the correct decision was demonstrated when a linear regression analysis of the equation produced a confidence coefficient of $R^2=0.89$. A further example of a factor which may be found to have little influence on the comparison of the variables to the performance curve is the reservoir pressure term. For example, when it was not used in the study referred to above the equation produced a confidence coefficient of $R^2=0.85$.

The porosity data used in the comparison came from cross plots of well logging data rather than from direct measurements of core material because it eliminated problems associated with lost core within the reservoir interval. All other core data was depth-corrected by using smoothed core porosity shifted relative to the wire line well log cross-plot porosity.

Figure 2:
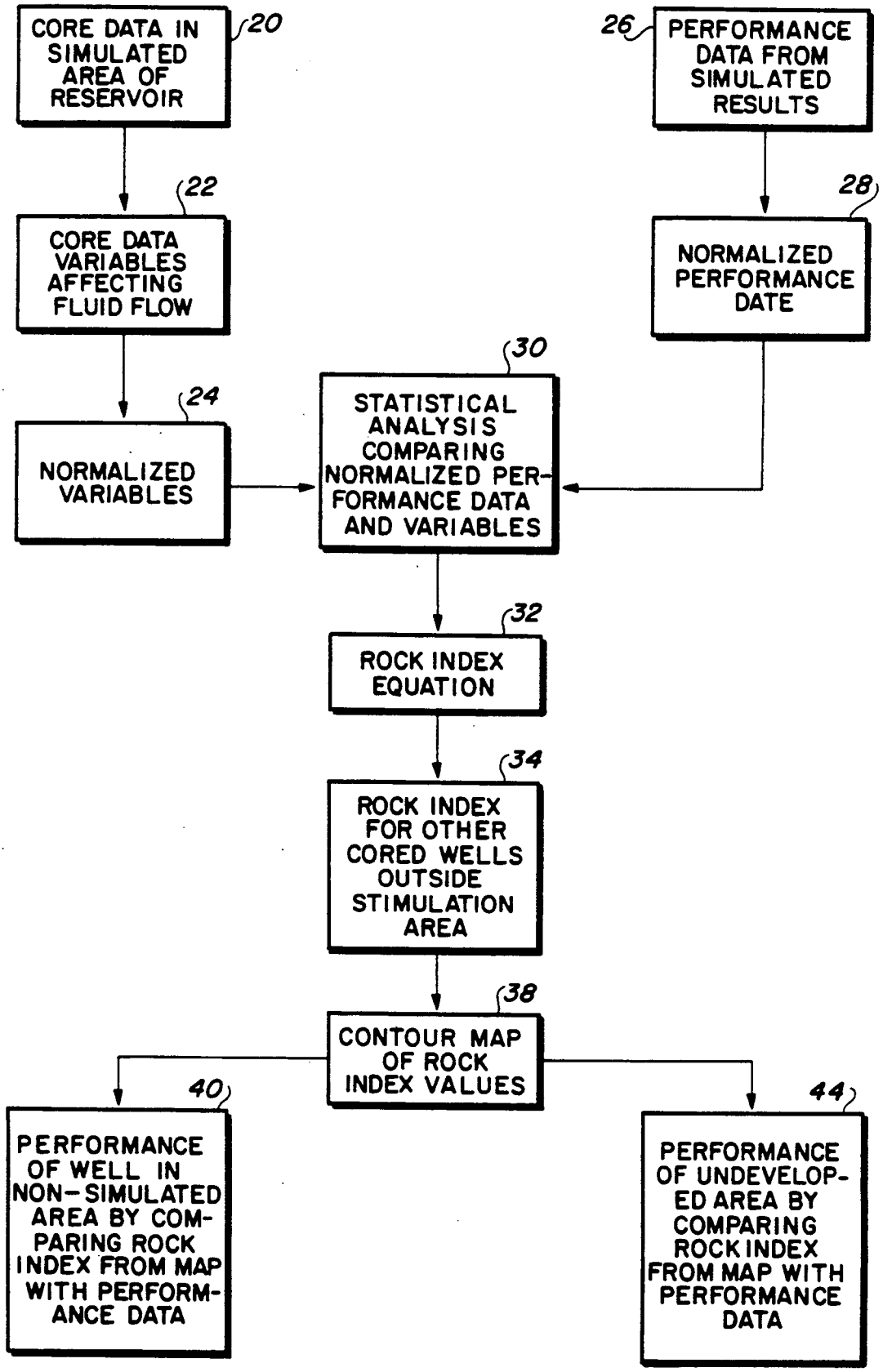
FIG. 2 is a flow chart of the method of the present invention.

Referring to FIG. 2, the method of the invention first involves obtaining core data 20 from within the computer simulated area of the reservoir. In terms of the simplified map of FIG. 1, the data would come from the cored wells 12 in the simulated area 14. Variables 22 of the core data which are significant to fluid flow properties of the reservoir are then selected and normalized at 24 so as to present them in dimensionless terms. Performance data 26 from performance curves of the reservoir computer simulation area 14 are also normalized as at 28 in the form of a dimensionless term related to the production of oil so that the normalized core data variables can be compared to the performance curves of the computer reservoir simulation.

The normalized core data variables 24 and the normalized performance data 28 are then entered into a computer statistical analysis program 30 which compares the rock index values to the respective values on the performance curves to produce a rock index equation 32. As stated above, this equation would be expressed in terms of the ratios comprising the normalized core data variables, with each ratio being multiplied by a different constant and with the products of such multiplication being added to yield a numerical index. Using the newly created rock index equation, the rock index values 34 are computed for each of the cored wells 16 shown in the non-simulated area 18 of FIG. 1.

Figure 3:
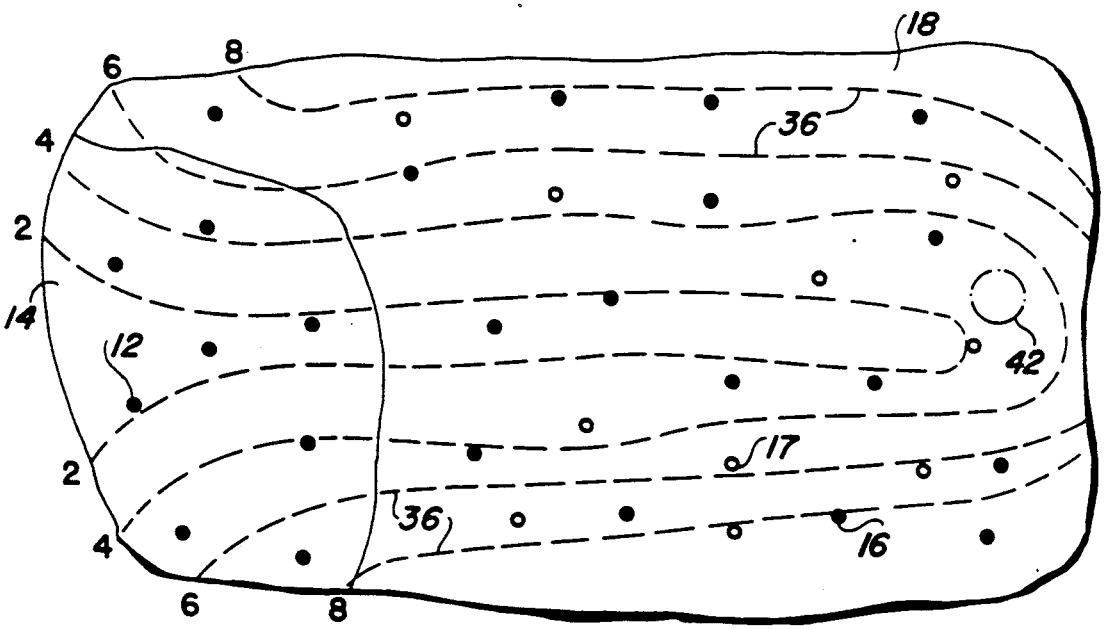
FIG. 3 is a simplified plan view similar to that of FIG. 1, but showing a typical set of index contour lines derived by the invention.

Referring now to FIGS. 1 and 3, the rock index values of all the cored wells 12 and 16 are recorded on the map and lines 36 are drawn to connect points of equal index values. This produces a contour or iso-index map as shown in FIG. 3, which is also indicated in FIG. 2 at step 38. The contour map, in connection with the performance curves of the reservoir simulation, can now be used to check the performance of existing wells and to forecast the performance of future wells in undeveloped areas of the reservoir.

Referring to FIGS. 2 and 3, to check the performance of an existing uncored well 17 located outside the simulated area, as indicated at step 40 in the flow chart of FIG. 2, it is merely necessary to estimate the rock index value for the well according to its location on the contour map and compare the performance of the well to the performance predicted by the rock index value. Thus for the well 17 in FIG. 3, its location would result in an estimated rock index value of 5, which means that its expected performance should be equivalent to the value of the performance curve which correlates to a rock index value of 5.

To predict the performance of undeveloped area 42, in accordance with step 44 on the flow chart of FIG. 2, the rock index again would be estimated from the contour map. In the case of this example it can be seen that the rock index can be assigned a value of 3. It could therefore be expected that a well in this location would produce comparable to the production rates taken from the performance curves of the reservoir simulation which correspond to this rock index value.

It will now be appreciated that the invention permits the production of existing wells in an unmodeled reservoir area to be checked, or the production of proposed wells in an unmodeled reservoir area to be forecasted, without the necessity of simulating the entire reservoir area or even using additional window areas to estimate the performance. Instead it is now merely necessary to use existing core data from wells located within and/or near the reservoir simulation area to build a rock index equation, and then to use existing core data outside the simulation area to estimate the rock index value for the wells and undeveloped areas outside the reservoir simulation area. Thus relatively inexpensively obtained core data can be used to extrapolate well performance expeditiously into the non-simulated portion of the reservoir.

As pointed out above, the particular variables selected to be used to derive the rock index equation may vary from one reservoir formation to another, but in any case they must always be normalized in the form of a ratio to permit comparison with the normalized performance data.

It will be understood that changes to the method which do not affect the overall basic function and concept of the invention may be made without departing from the spirit and scope of the invention, as defined in the appended claims.

We claim:

1. A method of extrapolating oil field reservoir computer simulation results from a portion of the reservoir to the entire reservoir, comprising the steps of:

obtaining core data from a plurality of oil wells in and/or near the portion of the reservoir which has been simulated;

selecting variables of the core data which affect fluid flow in the reservoir; normalizing the variables and performance data from the reservoir computer simulation so as to permit comparison of the variables to the performance data;

comparing through statistical analysis the normalized core data variables to the normalized performance data to thereby create an equation based on the sum of the normalized core data variables;

the numerical value resulting from the sum of the normalized core data variables comprising an index for each cored well which substantially corresponds to the performance data from the reservoir computer simulation;

obtaining core data from a plurality of additional oil wells in the reservoir outside the area which has been simulated;

normalizing the additional core data and using the equation to computer a numerical index for each additional oil well;

constructing an iso-index map of the reservoir area; and checking the performance of a well in the reservoir outside the area which has been simulated by determining the numerical index of the well from the iso-index map and comparing the performance of the well against the performance indicated by the numerical index.

2. A method according to claim 1, wherein the performance data is normalized by reducing the value of each performance curve of interest to the percent pore volume of oil produced per pore volume of injected fluid and wherein the core data variables are normalized by expressing them as a dimensionless ratio which compares a numerical value to a selected numerical standard.

3. A method of extrapolating oil field reservoir computer simulation results from a portion of the reservoir to the entire reservoir, comprising the steps of:

obtaining core data from a plurality of oil wells in and/or near the portion of the reservoir which has been simulated;

selecting variables of the core data which affect fluid flow in the reservoir;

normalizing the variables and performance data from the reservoir computer simulation so as to permit comparison of the variables to the performance data;

comparing through statistical analysis the normalized core data variables to the normalized performance data to thereby create an equation based on the sum of the normalized core data variables;

the numerical value resulting from the sum of the normalized core data variables comprising an index for each cored well which substantially corresponds to the performance data from the reservoir computer simulation;

obtaining core data from a plurality of additional oil wells in the reservoir outside the area which has been simulated;

normalizing the additional core data and using the equation to computer a numerical index for each additional oil well;

constructing an iso-index map of the reservoir area; and predicting the performance of an undeveloped area in the reservoir outside the area which has been simulated by determining the numerical index of the undeveloped area from the iso-index map and predicting the performance of a well in the undeveloped area as indicated by the numerical index.

4. A method according to claim 3, wherein the performance data is normalized by reducing the value of each performance curve of interest to the percent pore volume of oil produced per pore volume of injected fluid and wherein the core data variables are normalized by expressing them as a dimensionless ratio which compares a numerical value to a selected numerical standard.

5. A method according to claim 4, wherein a plurality of core data variables are expressed in terms of the ratio of the number of units of length of cored rock exhibiting a particular flow-affecting quality of the rock to the total number of units of length of cored rock exhibiting a different standard.

6. A method according to claim 5, wherein the ratio of the bottom hole pressure of the cored well to the desired pressure maintenance pressure is an additional variable included in the data used to create the equation.

7. A method according to claim 5, wherein one of the normalized core data variables characterizes fracture intensity as the ratio of the number of cored units of length having at least one open natural fracture to the total number of cored units of length.

8. A method according to claim 5, wherein one of the normalized core data variables characterizes the non-reservoir rock content as the ratio of the number of cored units of length of a minimal porosity which contributes significant fluid flow in the reservoir to the total number of cored units of length.

9. A method according to claim 5, wherein one of the normalized core data variables characterizes porosity as the ratio of the number of units of length of reservoir interval having at least a porosity corresponding to a significant increase in fluid flow properties of the reservoir rock to the total number of units of length of rock having a minimal porosity which contributes significant fluid flow in the reservoir.

* * * * *

UNITED STATES PATENT AND TRADEMARK OFFICE

CERTIFICATE OF CORRECTION

PATENT NO. : 5,058,012

DATED : October 15, 1991

INVENTOR(S) : Steven B. Hinchman et al.

It is certified that error appears in the above-identified patent and that said Letters Patent is hereby corrected as shown below:

Col. 6, line 43: Delete "computer" and insert therefor --compute--.
Col. 7, line 18: Delete "computer" and insert therefor --compute--.

Signed and Sealed this

Twenty-third Day of February, 1993

*Attest:*

STEPHEN G. KUNIN

*Attesting Officer*

*Acting Commissioner of Patents and Trademarks*